United States Patent [19]

Winyard

[11] Patent Number: 5,072,488

[45] Date of Patent: Dec. 17, 1991

[54] METHOD AND APPARATUS FOR MOUNTING HINGES TO A DOOR FRAME

[75] Inventor: Rodney W. Winyard, Leavittsburg, Ohio

[73] Assignee: Amweld Building Products, Inc., Garrettsville, Ohio

[21] Appl. No.: 494,141

[22] Filed: Mar. 14, 1990

[51] Int. Cl.[5] ..... E05D 7/06; E05D 7/04

[52] U.S. Cl. ..... 16/241; 16/247

[58] Field of Search ..... 16/240, 241, 246, 247, 16/DIG. 43, DIG. 42, DIG. 39, 249

[56] References Cited

U.S. PATENT DOCUMENTS

| | | | |
|---|---|---|---|
| 310,033 | 12/1884 | Collamore | 16/246 |
| 794,454 | 7/1905 | Davis et al. . | |
| 992,617 | 5/1911 | Varchmin et al. . | |
| 1,314,732 | 9/1919 | Cochran et al. . | |
| 2,940,115 | 6/1960 | Hansen . | |
| 4,007,514 | 2/1977 | Salice . | |
| 4,304,027 | 12/1981 | Di Fazio . | |
| 4,547,930 | 10/1985 | King et al. . | |
| 4,553,286 | 11/1985 | Schwarz, II . | |
| 4,554,706 | 11/1985 | Röck et al. . | |
| 4,815,162 | 3/1989 | McAteer . | |
| 4,825,507 | 5/1989 | Killingstad | 16/249 |

*Primary Examiner*—Robert L. Spruill
*Assistant Examiner*—Carmine Cuda
*Attorney, Agent, or Firm*—Watts, Hoffmann, Fisher & Heinke

[57] ABSTRACT

A hinge preparation assembly is mounted in hinge cutouts of a steel door frame. The hinge preparation assembly is capable of mounting either standard weight hinges or heavy weight hinges. Set screws are provided for positioning a standard weight hinge leaves and for adjusting a door clearance.

7 Claims, 3 Drawing Sheets

METHOD AND APPARATUS FOR MOUNTING HINGES TO A DOOR FRAME

BACKGROUND OF THE INVENTION

1. Field of the Invention

This invention relates to hinge preparation assemblies, and more particularly, to an adjustable hinge preparation assembly adapted to receive standard or heavy weight hinges.

2. Background Information

Hinge cutouts or mortises are usually made during the formation of the hinge jamb members of a steel door frame. A hinge reinforcement member, in the form of a plate or channel is generally welded across the hinge cutouts and serves to support a hinge leaf. The hinge reinforcement member has threaded holes corresponding to the holes in the hinge leaf.

In order to avoid the necessity of separately manufacturing and stocking door frames that will accommodate either standard weight or heavy weight hinges, efforts have been made in the past to provide hinge preparation assemblies that would permit converting from a standard weight to a heavy weight hinge without changing the depth of the cutouts.

In one such effort, a wire shim was positioned between a standard weight hinge and the reinforcement member. Removal of the shim allowed the reinforcement member to accommodate heavy weight hinges. U.S. Pat. No. 4,547,930 to King et al. is illustrative of such an effort. This arrangement does not permit adjustment of the door clearance at the door's strike edge.

In another effort, an adaptor piece incorporating a breakaway shim was mounted to the hinge reinforcement member. To convert the door frame to accept heavy weight hinges, the breakaway shim was removed. U.S. Pat. No. 4,553,286 to Schwartz disclosed such a device. This arrangement also did not permit adjustment of the door clearance at the strike edge of the door, and it permitted only one-time use of the breakaway shim.

SUMMARY OF THE INVENTION

An object of the present invention is to provide an improved hinge preparation assembly and method for mounting either standard weight or heavy weight hinges.

Another object of the invention is to provide a hinge preparation assembly and method for rapidly converting from a heavy weight hinge preparation to a standard weight hinge preparation or from a standard weight hinge preparation to a heavy weight hinge preparation.

Another object of the invention is to provide an improved hinge preparation assembly which provides for adjustable door clearances by permitting side to side adjustment of a door relative to the strike jamb of the door frame.

The present invention achieves the foregoing objectives by providing a hinge preparation assembly comprising a hinge reinforcing plate adapted to fit in each cut-out section of the door frame, the plate being recessed from the surface of the hinge jamb a distance that is greater than the thickness of a standard weight hinge leaf, but less than the thickness of a heavy weight hinge leaf, and provided with a plurality of screw holes; and at least one set screw adapted to adjustably project from the surface of each plate. The set screws are located adjacent the screw holes under the hinge leaves secured to the plates by screws extending into the screw holes. When mounting standard weight hinges, the set screws can be threaded into or out of the reinforcing plates in order to move the lock edge of the door toward or away from the strike jamb of the frame, thereby adjusting the door clearance. When mounting heavy weight hinges, the set screws are either threaded in to be flush with the plates or they are removed. The described arrangement permits conversion from heavy weight hinge mounting back to standard weight mounting.

Other objects and advantages and a fuller understanding of the invention will be had from the following detailed description of a preferred embodiment and the accompanying drawings.

DESCRIPTION OF THE PREFERRED EMBODIMENT

Figure 1:
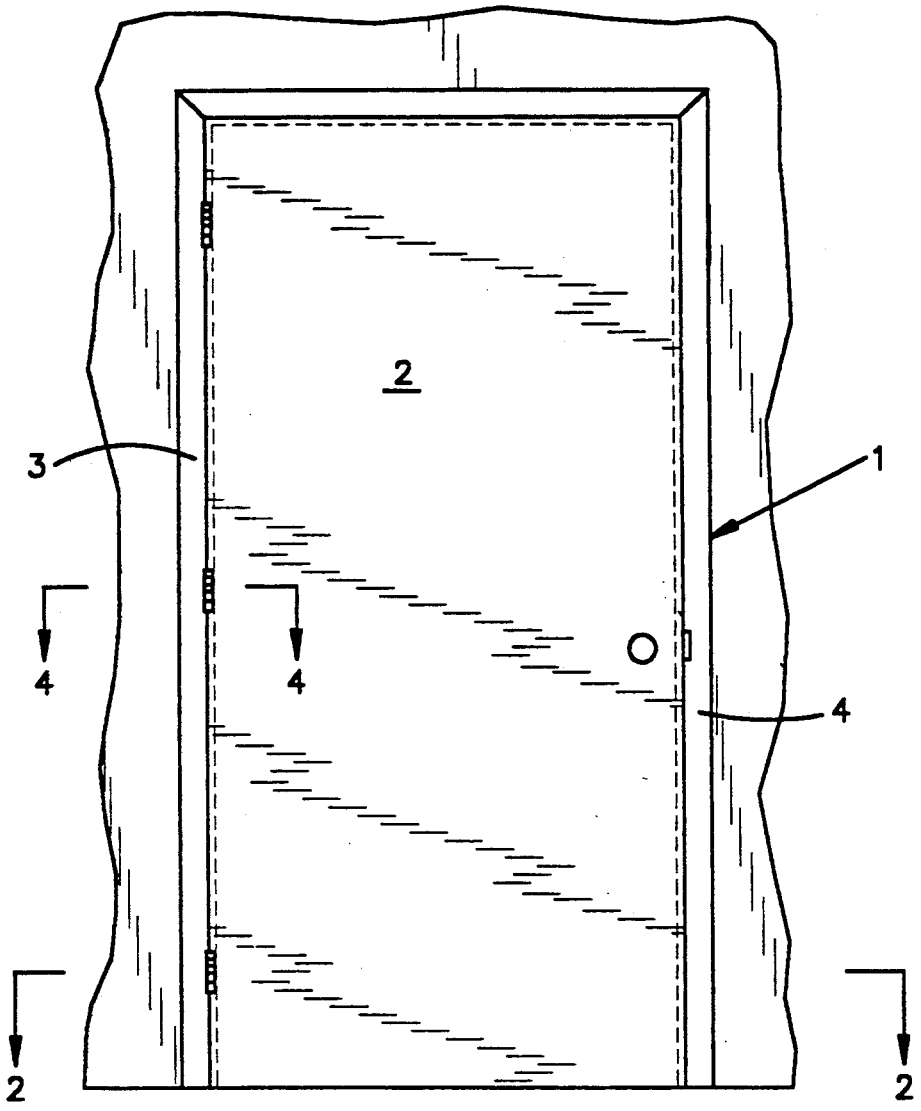
FIG. 1 is an elevational plan view of a steel door and steel frame made in accordance with the present invention.
Figure 2:
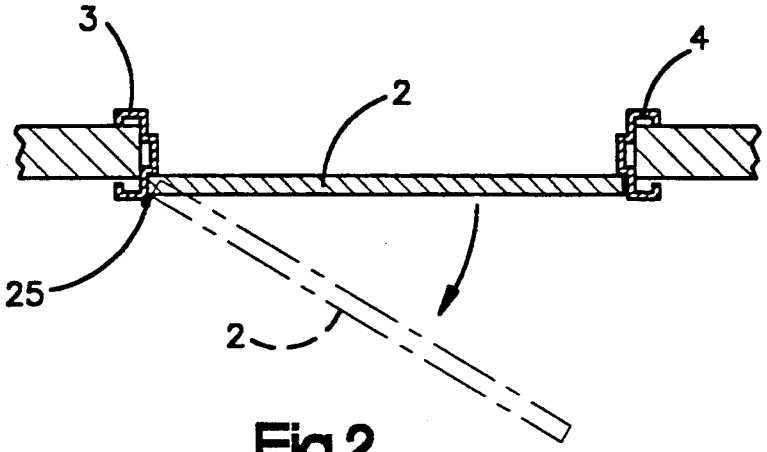
FIG. 2 is a sectional view taken along the line 2—2 of FIG. 1.
Figure 3:
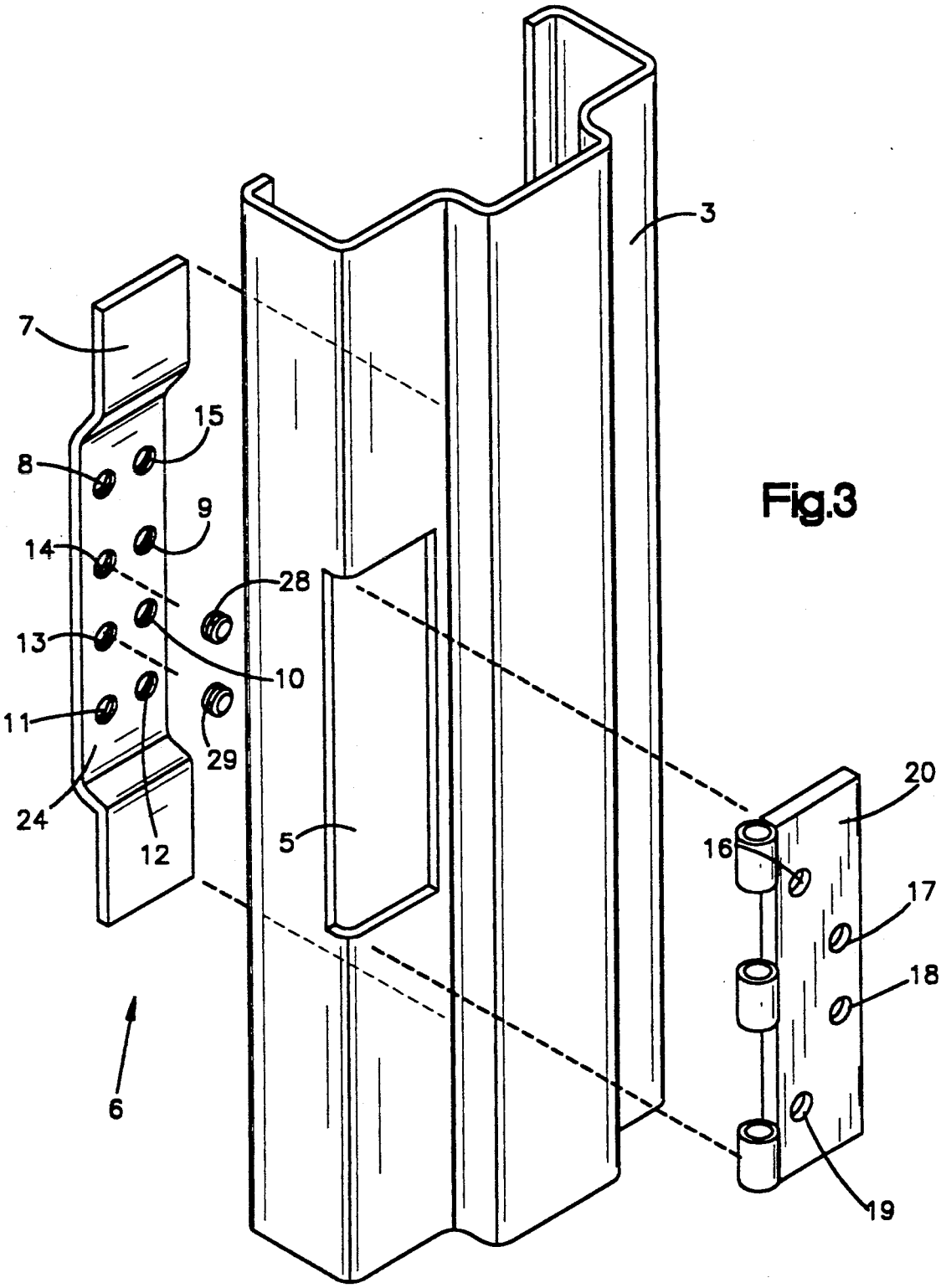
FIG. 3 is an exploded view, in perspective, of a section of the hinge jamb, showing the hinge preparation of the present invention.

Referring to FIGS. 1-3, a steel door frame 1 is shown supporting a door 2. The door frame comprises a hinge jamb 3, and a strike jamb 4. Hinge cutouts 5 are formed in the hinge jamb 3 at spaced intervals. A hinge preparation assembly 6 serves to mount the door 2 to the door frame 1.

The hinge preparation assembly 6 comprises hinge reinforcement members 7 mounted to the inside of the hinge jamb 3 so as to bridge the hinge cutouts 5. The members 7 are mounted to the hinge jamb 3 by spot welding or other conventional means. Each hinge reinforcement member 7 of the present invention comprises a plurality of spaced apart threaded holes 8-15. In the arrangement of FIG. 3, holes 8-11 serve to secure the standard weight or heavy weight hinge leaf 20 to the reinforcement member 7. The hinge leaf 20, whether standard or heavy weight, includes four threaded holes 16-19 arranged in a C-pattern for mounting. If a hinge is to be mounted on the other side of the hinge jamb 3 for swinging in the opposite direction, the hinge reinforcement member 7 may be rotated end to end before it is mounted to the hinge jamb. Alternatively, threaded holes 12-15 may be used to mount the hinge leaf 20.

Each hinge reinforcement member 7 of the present invention comprises a recess 21. The recess 21 is approximately 0.157 inches deep from the outer surface of the hinge jamb 3. The thickness of a standard weight hinge leaf 22 is approximately 0.134 inches and the thickness of a heavy weight hinge leaf 23 is approximately 0.180 inches. The recess 21, measured from the outer surface of the hinge jamb 3 to a hinge mounting surface 24 of the hinge reinforcement member 7, is therefore greater than the thickness of a standard weight hinge leaf 22 but less than the thickness of a heavy weight hinge leaf 23.

Hinges 25 are mounted to the hinge reinforcement members 7 by fastening a hinge leaf 20 to the hinge reinforcement member 7 with hinge mounting screws (not shown). The other hinge leaf 26 of each hinge 25 is fastened to the door 2 in a conventional manner.

Figure 4:
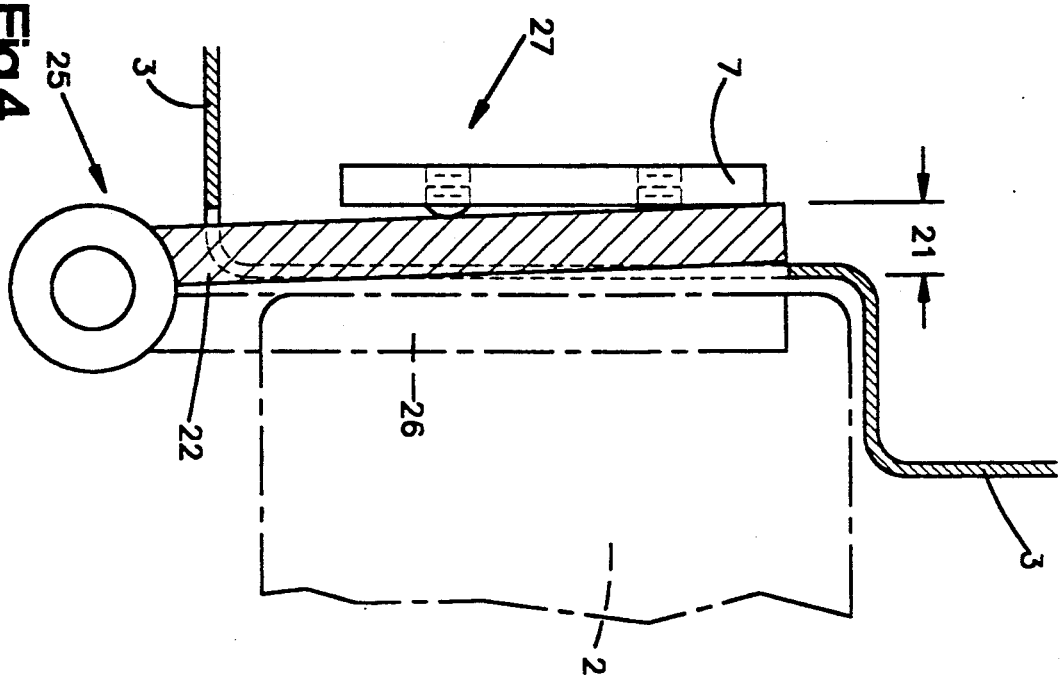
FIG. 4 is a fragmentary, cross-sectional view taken along the line 4—4 of FIG. 1 when standard weight hinges are mounted with the hinge preparation of the present invention; and, FIG. 5 is a fragmentary, cross-sectional view taken along the same line as FIG. 4 when heavy weight hinges are mounted with the hinge preparation of the present invention.

The hinge preparation 6 of the present invention comprises an adjustment mechanism 27 for positioning a standard weight hinge leaf 22 and for adjusting the door position from side to side with respect to the door frame 1 when a standard weight hinge is used. As shown in FIG. 4, the adjustment mechanism 27 comprises a plurality of set screws 28,29 threaded into the unused holes 13,14. This positions the set screws 28,29 within the c-pattern of threaded screw holes 8–11 of the hinge reinforcement member 7 as seen in FIG. 3.

When standard weight hinges are secured to the reinforcement plates 7, the ends of the set screws 28,29 will engage the hinge leaves 22 as shown in FIG. 4. The set screws 28,29 can be threaded in or out to extend a predetermined distance from the hinge reinforcement member 7. The distance the set screws 28,29 extend from the hinge reinforcement member 7 determines the clearance between the door 2 and the strike jamb 4 once the door 2 is mounted.

Figure 5:
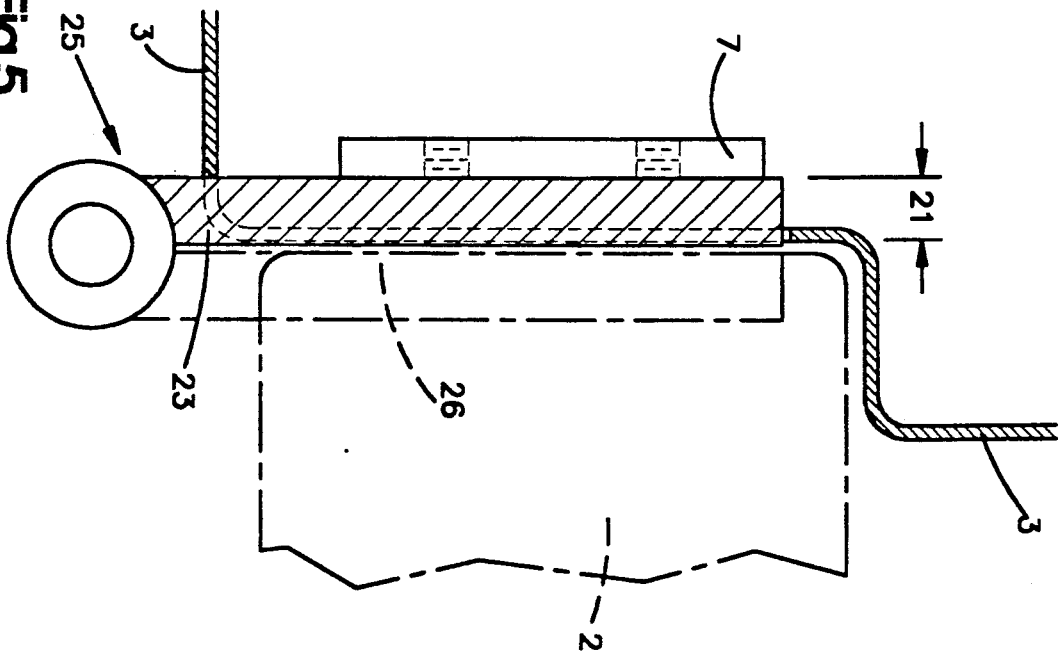

Heavy weight hinge leaves 23 are secured in abutting contact with the hinge mounting surface 24 of the hinge reinforcement plate 7 of the hinge preparation assembly 6 as shown in FIG. 5. The set screws 28,29 have no role in mounting a heavy weight hinge. The set screws 28,29 may be removed or threaded in to be flush with the hinge mounting surface 24 of the reinforcement plate 7 to permit the heavy weight hinge leaves to be secured in abutting contact with the hinge reinforcement plate 7.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A hinge preparation assembly for mounting either standard weight or heavy weight hinges to a door frame having a hinge jamb provided with vertically spaced hinge cut-out sections and a strike jamb, said assembly comprising:

a hinge reinforcing plate bridging each cut-out section, said plate having a planar mounting surface recessed from the surface of said hinge jamb a distance that is greater than the thickness of a standard weight hinge leaf, but less than the thickness of a heavy weight hinge leaf;

each of said plates having a plurality of threaded screw holes and at least one set screw adapted to adjustably project from the surface of said plate;

said set screws being mounted in certain of said screw holes, whereby standard weight hinge leaves secured to said plates by screws extending into said screw holes will engage the ends of said set screws and will rest at an angle to the plane of the mounting surface, said set screws adapted to be threaded in and out to adjust door clearance by varying said angle; and said set screws being either removable or adjustable flush with the surfaces of said plates to permit heavy weight hinge leaves to be secured in abutting contact to said mounting surface.

2. A hinge preparation assembly according to claim 1 wherein said set screw is hidden from view by said standard weight hinge leaf.

3. A hinge preparation assembly according to claim 1, wherein said hinge reinforcing plate is adapted to mount a heavy weight hinge leaf parallel to and in face to face contact with said mounting surface such that said heavy weight hinge leaf projects beyond the surface of said hinge jamb when secured to said plate.

4. A process for mounting a standard weight hinge leaf to a door frame hinge preparation assembly capable of mounting either a standard weight hinge leaf or a heavy weight hinge leaf comprising the steps of:

providing a door frame having a hinge jamb with vertically spaced aligned hinge cut-out sections;

mounting a hinge reinforcement member having a planar mounting surface adjacent to each said hinge cut-out section to form a recess, the depth of said recess being less than the thickness of a heavy weight hinge leaf but greater than the thickness of a standard weight hinge leaf;

engaging at least one set screw with said hinge reinforcement member;

threading said set screw in or out to cause said set screw to extend a predetermined distance from said hinge reinforcement member;

mounting a standard weight hinge leaf at an angle to said mounting surface and in engagement with said set screw so that one edge of said standard weight hinge leaf pivotally engages said mounting surface and a surface of said standard weight leaf facing said door frame engages said set screw to hide said set screw from view.

5. A hinge preparation assembly for adjustably mounting a door to a door frame with either standard weight or heavy weight hinges, said assembly comprising:

a hinge reinforcing plate having a planar mounting surface recessed from the surface of said door frame a distance that is greater than the thickness of a standard weight hinge leaf, but less than the thickness of a heavy weight hinge leaf, said mounting surface having a plurality of threaded screw holes and at least one set screw adapted to adjustably project from said mounting surface, said assembly being adapted to support a standard weight planar hinge leaf secured to said mounting surface in engagement with said set screw such that one edge of said leaf pivotally engages said mounting surface along a line of engagement and a surface of said leaf facing said door frame engages said set screw such that said leaf lies at an angle with respect to the plane of said mounting surface, said angle being variable by threading said set screw inward or outward to adjust the position of said door.

6. A hinge preparation assembly according to claim 5, wherein said set screw is hidden from view by said leaf.

7. A hinge preparation assembly according to claim 5, wherein said hinge reinforcing plate is adapted to mount a heavy weight hinge leaf parallel to and in face to face contact with said mounting surface such that said heavy weight hinge projects beyond the surface of said door frame when secured to said plate.

* * * * *